US006582157B1

(12) United States Patent
Takeuchi et al.

(10) Patent No.: US 6,582,157 B1
(45) Date of Patent: Jun. 24, 2003

(54) DIVING JACKET

(75) Inventors: Minoru Takeuchi, Tokyo (JP); Masaji Fujiwara, Tokyo (JP); Kenji Kawana, Tokyo (JP)

(73) Assignee: Tabata Co. Ltd., Tokyo (JP)

( * ) Notice: Subject to any disclaimer, the term of this patent is extended or adjusted under 35 U.S.C. 154(b) by 0 days.

(21) Appl. No.: 10/149,292

(22) PCT Filed: Oct. 13, 2000

(86) PCT No.: PCT/JP00/07139

§ 371 (c)(1),
(2), (4) Date: Jun. 11, 2002

(87) PCT Pub. No.: WO02/32756

PCT Pub. Date: Apr. 25, 2002

(51) Int. Cl.[7] ..... B63C 11/02; B63C 11/22
(52) U.S. Cl. ..... 405/186; 441/92
(58) Field of Search ..... 405/185, 186; 441/92

(56) References Cited

U.S. PATENT DOCUMENTS

| | | | | |
|---|---|---|---|---|
| 4,779,554 A | * | 10/1988 | Courtney | 114/315 |
| 4,990,115 A | * | 2/1991 | Vorhauer et al. | 441/111 |
| 5,363,790 A | | 11/1994 | Matsuoka | 114/315 |
| 5,522,679 A | | 6/1996 | Eungard | 405/186 |

FOREIGN PATENT DOCUMENTS

| | | | | |
|---|---|---|---|---|
| JP | 58-124395 | | 8/1983 | |
| JP | 05112291 A | * | 5/1993 | B63C/11/02 |
| JP | 08258788 A | * | 10/1996 | B63C/11/02 |

* cited by examiner

*Primary Examiner*—Thomas B. Will
*Assistant Examiner*—Tara L. Mayo
(74) *Attorney, Agent, or Firm*—Clark & Brody

(57) ABSTRACT

A diving jacket 1 having a strap 26 extending from one of paired shoulder regions 7 to the other of the shoulder regions 7 via an upper end of the jacket 1. The strap 26 has its opposite ends fixed to the shoulder regions 7 and the length of the strap 26 is adjustable in at least one of the shoulder regions 7.

4 Claims, 5 Drawing Sheets

DIVING JACKET

TECHNICAL FIELD OF THE INVENTION

This invention relates to a diving jacket.

BACKGROUND ART

It is well known to provide a back pad with a main belt used to fold an air tank along its body and a sub-belt adapted to be draped about the top of the air tank in the vicinity of a valve so that a main belt may hold the air tank on a jacket and the sub-belt may prevent the air tank from unintentionally falling off.

With a conventional jacket discribed above, it is certainly possible to hold a cylindrical body of the air tank on a jackets wearer's back using the main melt but it is difficult to fix the top of the air tank since the air tank is relatively long. Consequently, the top of the air tank is apt to move uncontrollably, i.e., to get near to or away from the wearer's back. Such movement of the air tank may often obstruct the wearer from freely swimming. The sub-belt, on the other hand, has its opposite ends stitched to a neck of the jacket to form an annular belt. While it is possible for such sub-band to be loosely draped about the top of the air tank, such sub-belt is not suitable to suppress a movement of the tank's top.

It is an object of this invention to provide a diving jacket adapted to fix not only a cylindrical body of the air tank but also the top of the air tank to the wearer's back.

SUMMARY OF THE INVENTION

According to this invention, there is provided a diving jacket comprising a back pad, a pair of shoulder regions extending from an upper end of the back pad on right and left sides thereof beyond wearer's shoulders into a front body side, and a means to hold an air tank on the back pad.

The jacket is further provided with a strap extending from one of the shoulder regions to the other shoulder region via the upper end of the back pad and adapted to encircle a top of the air tank in the vicinity of the upper end and the strap has its opposite ends fixed to the shoulder regions and is adapted to be length-adjustable in at least one of the shoulder regions.

In one preferred embodiment of this invention, the strap is adapted to be length-adjustable in one of the shoulder regions.

In another preferred embodiment of this invention, the strap is adapted to be length-adjusted by a buckle or buckles.

In still another preferred embodiment of this invention, the strap is adapted to be length-adjusted by a so-called mechanical fastener.

PREFERRED EMBODIMENTS OF THE INVENTION

Details of a diving jacket according to this invention will be more fully understood from the description given hereunder in reference to the accompanying drawings.

Figure 1:
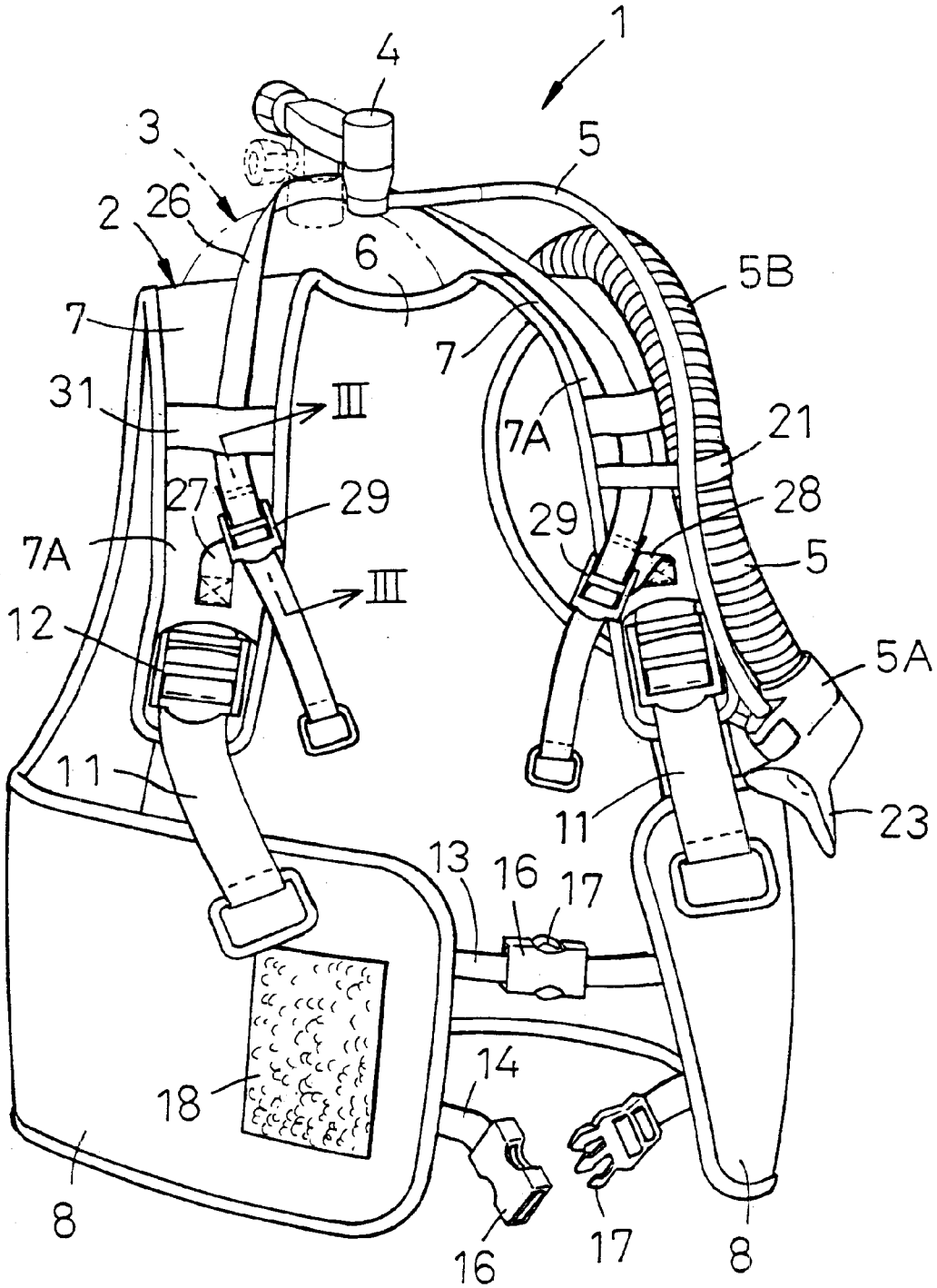
FIG. 1 is a perspective view showing the jacket as viewed from its front side.
Figure 2:
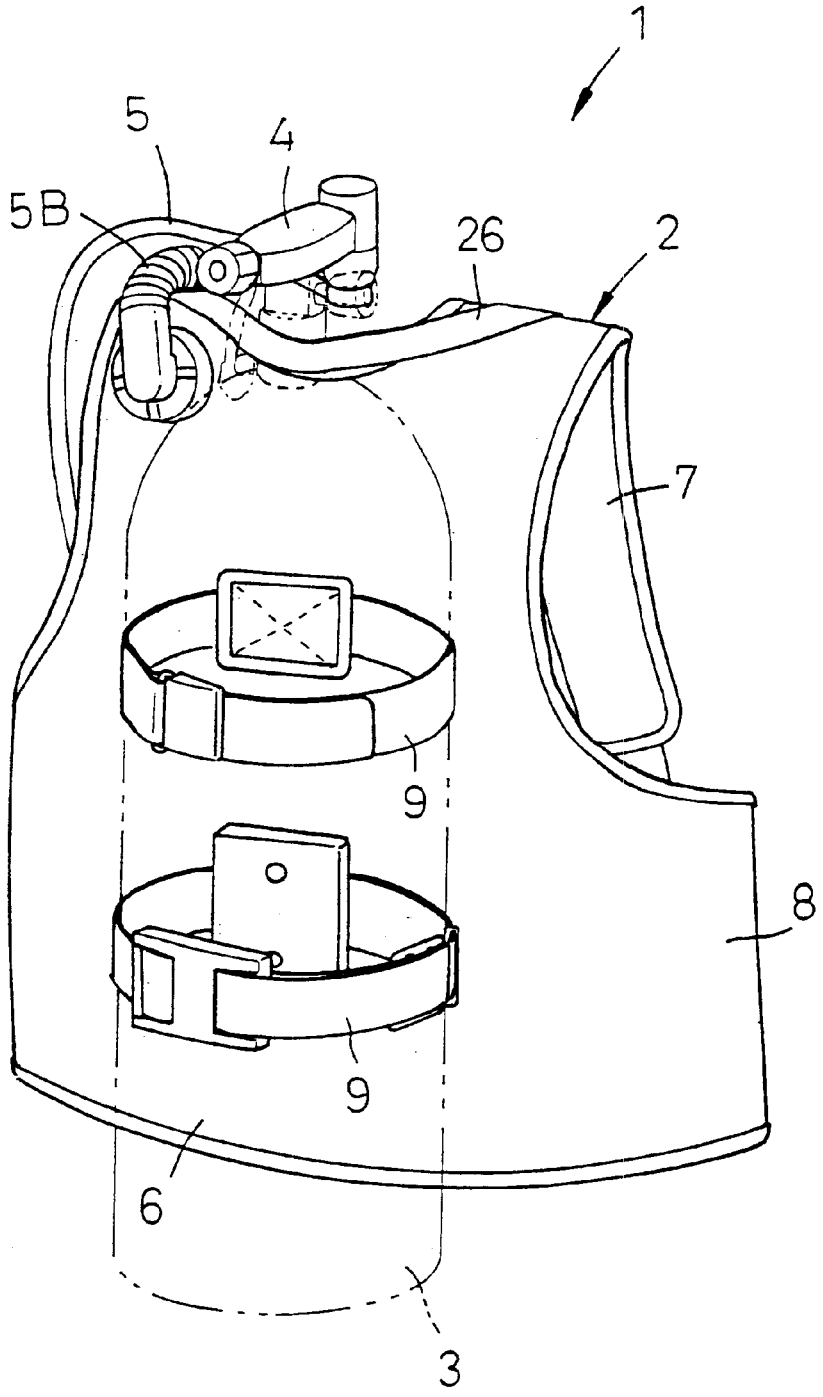
FIG. 2 is a perspective view showing the jacket as viewed from its back side.

FIG. 1 is a perspective view showing a jacket 1 as viewed from its front side and FIG. 2 is a perspective view showing the jacket 1 as viewed from its back side. The jacket 1 comprises a jacket body 2 adapted to give a wearer buoyancy by an appropriate amount of air supplied into its interior with a medium pressure hose 5 extending from the jacket body 2 and connected via a first stage 4 to an air tank 3 indicated by imaginary lines, and an inflator hose 5B extending from a second stage 5A mounted on a distal end of the medium hose 5 and connected to a rear side of the jacket body 2. The jacket body 2 includes a back pad 6, a pair of shoulder regions 7 adapted to extend from an upper end at right and left regions beyond shoulders toward the front side, and a pair of trunk regions 8 adapted to extend forward circumferentially from transversely opposite sides of the back pad 6. A pair of upper and lower length-adjustable belt pieces 9 used to fasten the tank 3 are attached to the back pad 6.

The respective shoulder regions 7 comprise a pair of extensions 7A and a pair of connector straps 11 separately of the respective extensions 7A. The respective extensions 7A are length-adjustably connected to the respective connector straps 11 by means of buckles 12. Lower ends of the respective connector straps 11 are fixed to the trunk regions 8.

These trunk regions 8 respectively have paired straps 13, 14 attached to the inner side of these trunk regions 8 and can be retained in close contact with the wearer's torso by these straps 13, 14.

The straps 13, 14 include female and male buckles 16, 17, respectively, which are detachably engaged with each other so that the straps 13, 14 may be length-adjustably connected to each other. Alternatively or additionally, one of the paired trunk regions 8 may be provided on its outer surface with a female member 18 of a so-called mechanical fastener and the other trunk region 8 may be provided on its inner surface with a male member (not shown) of the mechanical fastener to ensure that the pair of trunk regions 8 are retained in close contact with the wearer's torso.

The medium pressure hose 5 and the inflator hose 5B connected to each other via the second stage 5A are held on the left side of the shoulder regions 7 by a band member 21 provided in this shoulder region. A mouth piece 23 is attached to the second stage 5A.

In the jacket body 2 as has been described above, a tank holding strap 26 extends from one of the shoulder regions 7 to the other of the shoulder regions 7 via the upper end of the jacket body 2. Opposite ends 27, 28 of the tank holding strap 26 are fixed to the shoulder regions 7 by stitching. Such tank holding strap 26 preferably includes a means to adjust an effective length of the strap 26, for example, buckle or buckles 29 as in the illustrated embodiment so as to be operatively associated with one or both of the shoulder regions 7. The tank holding strap 26 may be draped about the top of the tank fixed to the jacket body 2 and tightened between the opposite ends 27, 28 using the buckle or buckles 29 to draw a top of the tank 3 toward the wearer's back and thereby to fix the top of the tank 3 thereto. If the tank 3 is fixed to the wearer's back in this manner, it will not make, however hard the wearer behaves, the top of the tank move unstably on the back of the wearer and will not prevent the wearer of the jacket 1 from moving freely. The tank holding strap 26 is held in the respective shoulder regions 7 by respective band members 31 provided in the respective shoulder regions 7.

Figure 3:
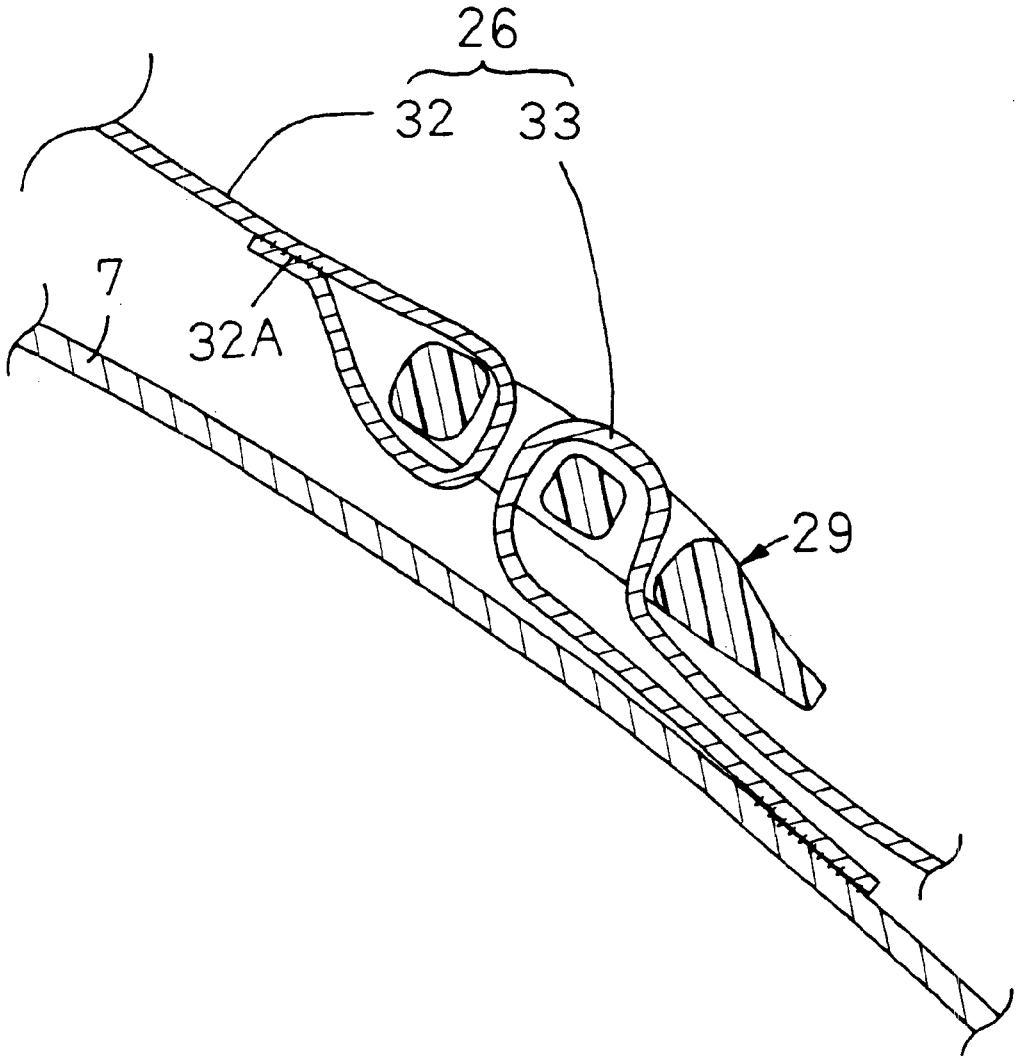
FIG. 3 is a fragmentary sectional view taken along a line III—III in FIG. 1.

FIG. 3 is a fragmentary sectional view taken along a line III—III in FIG. 1, showing a major part. The tank holding strap 26 is divided into upper and lower regions 32, 33 in each of the shoulder regions 7 so that an end of the upper region 32 inserted through the associated buckle 29 is folded back onto and stitched to this upper region 32 at its zone 32A to retain the buckle 29 while the lower region 33 is length-adjustably inserted through the buckle 29.

Figure 4:
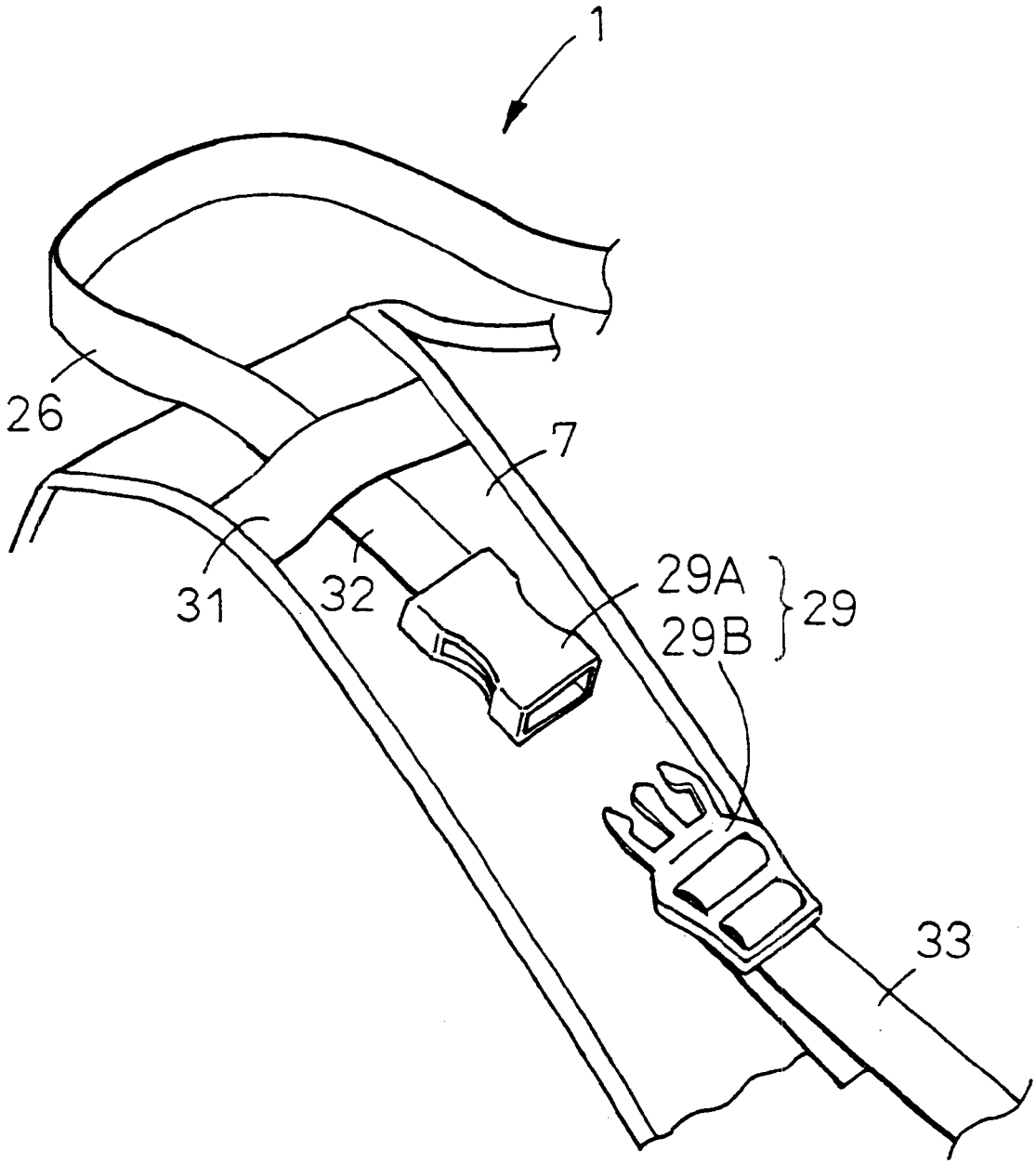
FIG. 4 is a fragmentary perspective view of the jacket showing a specific embodiment of the strap used to hold the air tank.

FIG. 4 is a fragmentary perspective view of the jacket showing a specific embodiment of the strap 26 and the buckle 29 used to hold the air tank. The buckle 29 comprises female and male members 29A, 29B detachably engaged with each other of which the female member 29A is attached to the tank holding strap 26 in its upper region 32 and the male member 29B is attached to the strap 26 in its lower region 33 so that the effective length of the strap 26 may be adjusted by this male member 29B.

Figure 5:
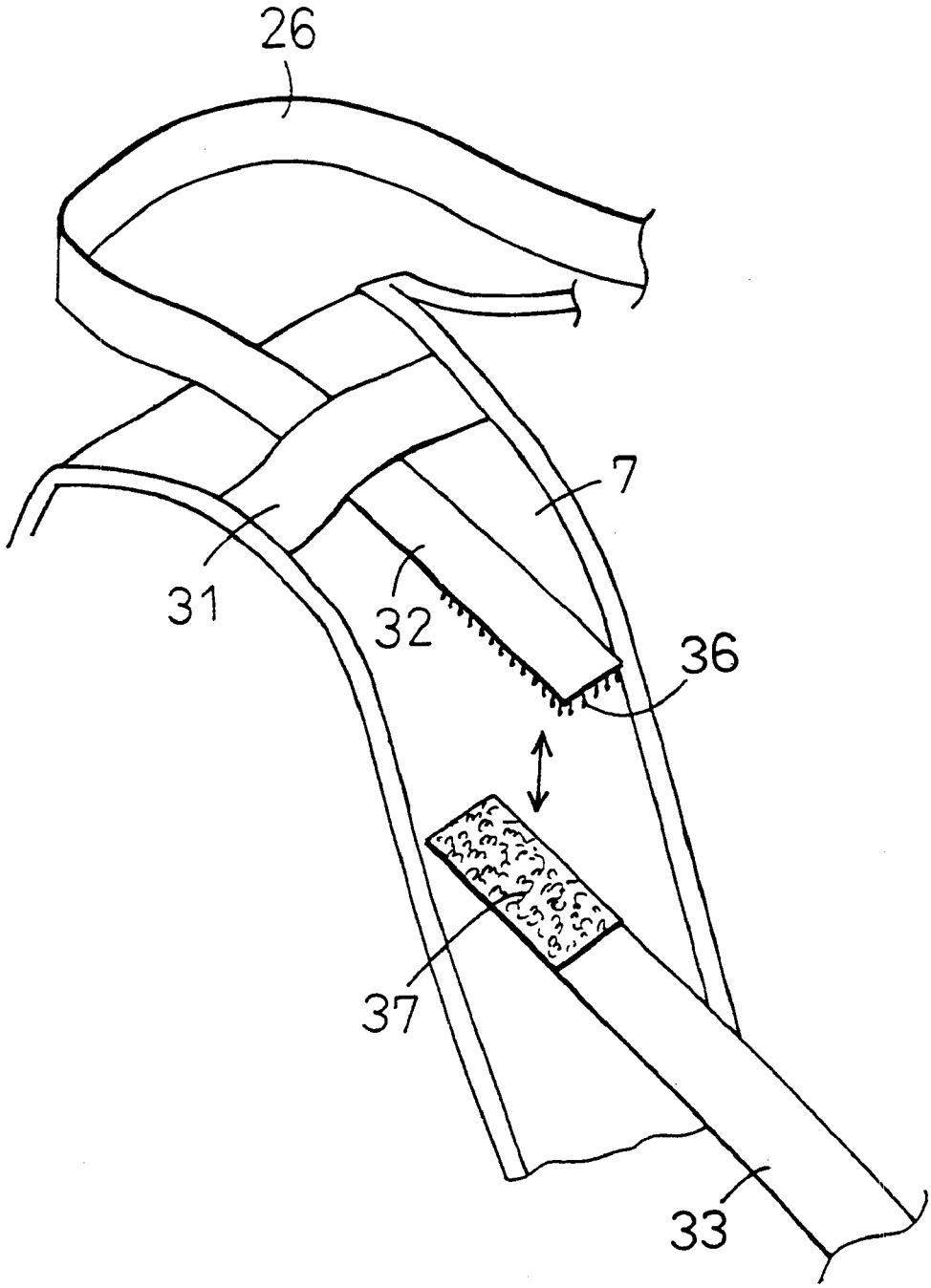
FIG. 5 is a view similar to FIG. 4 but showing another embodiment of the strap used to hold the air tank.

FIG. 5 is a view similar to FIG. 4 but showing another embodiment of the tank holding strap 26 and a means to adjust the length of the strap 26. The tank holding strap 26 is divided into the upper region 32 and the lower region 33 along at least one, or preferably along both of the shoulder regions 7. The strap 26 is provided in the upper region 32 with the male member 36 of the mechanical fastener well known by the trade name of MAGIC TAPE or the like and in the lower region 33 with the female member 37 of the mechanical fastener.

This invention is applicable not only to the jacket 1 with a buoyancy-adjustable function as has been described above but also to a jacket without a buoyancy-adjustable function.

In the diving jacket according to this invention, the tank holding strap adapted to be draped about the top of the tank extends to the respective shoulder regions and its length is adjustable in these shoulder regions. In other words, the length of the tank holding strap may be adjusted and tightened after the jacket has been worn to avoid an anxiety that the tank might unintentionally fall off due to the strap being slackened. Furthermore, it is not apprehended that the top of the tank might move unstably on the wearer back during the wearer is swimming or diving.

What is claimed is:

1. A diving jacket comprising:

a back pad;

a pair of shoulder regions extending from an upper end of said back pad on right and left sides thereof beyond a wearer's shoulders into a front body side;

a means to hold an air tank on said back pad;

said jacket being provided with a strap extending from one of said shoulder regions to the other shoulder region via said upper end of the back pad and adapted to encircle a top of said air tank in a vicinity of said upper end; and said strap having opposite ends thereof fixed to said shoulder regions and being adapted to be length-adjustable in at least one of said shoulder regions.

2. The jacket according to claim 1, wherein said strap is adapted to be length-adjustable in one of said shoulder regions.

3. The jacket according to claim 1, wherein said strap is adapted to be length-adjusted by a buckle or buckles.

4. The jacket according to claim 1, wherein said strap is adapted to be length-adjusted by a mechanical fastener.

* * * * *